US012352451B2

(12) United States Patent
Chung

(10) Patent No.: US 12,352,451 B2
(45) Date of Patent: Jul. 8, 2025

(54) ERROR-PROOF OPERATING SYSTEM FOR PORTABLE GAS HOB

(71) Applicant: MAXSUN (DALIAN) CO., LTD, Dalian (CN)

(72) Inventor: Hae Goog Chung, Dalian (CN)

(73) Assignee: MAXSUN (DALIAN) CO., LTD, Wuxi (CN)

( * ) Notice: Subject to any disclaimer, the term of this patent is extended or adjusted under 35 U.S.C. 154(b) by 349 days.

(21) Appl. No.: 18/000,330

(22) PCT Filed: Nov. 24, 2021

(86) PCT No.: PCT/CN2021/132604

§ 371 (c)(1),
(2) Date: Nov. 30, 2022

(87) PCT Pub. No.: WO2022/227520

PCT Pub. Date: Nov. 3, 2022

(65) Prior Publication Data

US 2023/0221003 A1 Jul. 13, 2023

(30) Foreign Application Priority Data

Apr. 28, 2021 (CN) ..... 202110468085.6

(51) Int. Cl.
*F24C 3/12* (2006.01)
*F24C 3/14* (2021.01)

(52) U.S. Cl.
CPC ..... *F24C 3/126* (2013.01); *F24C 3/14* (2013.01)

(58) Field of Classification Search
CPC ..... F24C 3/126; F24C 3/14; F24D 14/72
USPC ..... 126/38, 52, 42
See application file for complete search history.

(56) References Cited

FOREIGN PATENT DOCUMENTS

| | | | |
|---|---|---|---|
| CN | 201555258 U | * | 8/2010 |
| CN | 113091101 A | | 7/2021 |
| CN | 214745937 U | | 11/2021 |
| CN | 214745938 U | | 11/2021 |

OTHER PUBLICATIONS

International Search Report issued in International Application No. PCT/CN2021/132604; mailed Apr. 28, 2021; 10 pgs.
Written Opinion issued in International Application No. PCT/CN2021/132604; mailed Apr. 28, 2021; 9 pgs.

* cited by examiner

*Primary Examiner* — Vivek K Shirsat
(74) *Attorney, Agent, or Firm* — HAUPTMAN HAM, LLP

(57) ABSTRACT

An error-proof operating system for a portable gas hob includes a gas tank cavity partition having two ends respectively fixed to a front panel and a back panel, wherein a bounce limiting device is provided on the gas tank cavity partition, the bounce limiting device is connected to an actuating rod, the actuating rod is rotatably connected to the gas tank cavity partition, one end of the actuating rod penetrates through the front panel, and a top of the bounce limiting device is not lower than a bearing end for bearing a liquid holding tray. The beneficial effect of the present invention is: by providing the bounce limiting device and using same in conjunction with the liquid holding tray, user's operation is standardized to avoid dangerous accidents caused by incorrect operating.

9 Claims, 10 Drawing Sheets

ERROR-PROOF OPERATING SYSTEM FOR PORTABLE GAS HOB

RELATED APPLICATIONS

The present application is a U.S. National Phase of International Application Number PCT/CN2021/132604, filed Nov. 24, 2021, and claims priority to Chinese Application Number 202110468085.6, filed Apr. 28, 2021.

TECHNICAL FIELD

The present invention relates to an error-proof operating system for a portable gas hob, and relates to the technical field of portable gas appliances.

BACKGROUND

Before using a portable gas hob, it is necessary to mount the hob according to the product manual to ensure use safety. However, some users, especially those who use the gas hob for the first time, often directly mount the hob according to their own understanding without reading instructions, resulting in non-standardized mounting operation, causing product damage, and even causing dangerous accidents such as gas tank explosion during use.

SUMMARY

To overcome defects in the prior art, the present invention is intended to provide an error-proof operating system for a portable gas hob that can effectively prevent incorrect operation by users and avoid dangerous accidents.

The technical solution of the present invention is: an error-proof operating system for a portable gas hob, comprising a gas tank cavity partition having two ends respectively fixed to a front panel and a back panel, where a bounce limiting device is provided on the gas tank cavity partition, the bounce limiting device is connected to an actuating rod, the actuating rod is rotatably connected to the gas tank cavity partition, one end of the actuating rod penetrates through the front panel, and the top of the bounce limiting device is not lower than a bearing end for bearing a liquid holding tray.

The bounce limiting device comprises a pull rod slidably connected to the gas tank cavity partition, a gas tank driving part at an end of the pull rod penetrates through the gas tank cavity partition and is positioned in a gas tank cavity, the end of the actuating rod is movably connected to the pull rod, a spring a is connected between the pull rod and the gas tank cavity partition, a position-limiting notch is formed at the bottom end of the pull rod, a position-limiting piece matching the position-limiting notch is provided on a brake, the brake is movably connected to the gas tank cavity partition, a spring b is connected between the brake and the gas tank cavity partition, the top of the brake is not lower than the bearing end, the brake is rotatably connected to the gas tank cavity partition, a guide piece a movable along a guide slot a is provided on the brake, the guide slot a is located on the gas tank cavity partition, and an arc-shaped surface for reducing friction is provided at the top of the brake.

The liquid holding tray is a square, a pressing piece is provided at the bottom of one edge of the square, an avoidance groove is formed at the bottoms of the other three edges of the square, and the pressing piece is in detachable contact with the arc-shaped surface.

Hob feet are fixed at four corners of the liquid holding tray, the hob feet comprise two low hob feet and two high hob feet, and the two high hob feet are located on both sides of the pressing piece.

A position-limiting baffle is provided on the actuating rod, and a hob foot groove matching the position-limiting baffle is formed at the bottom of each hob foot.

An upper panel is fixed between the front panel and the back panel, the bearing end is fixed onto an inner ring of the upper panel, an avoidance hole is opened on the bearing end, and the top of the brake runs through the avoidance hole.

A square guide hole is opened on the gas tank cavity partition, and one end of the pull rod moves along the square guide hole.

One end of the spring a is connected to a hook c on the pull rod, and the other end of the spring a is connected to a hook b on the gas tank cavity partition; two ends of the spring b are respectively connected to a hook a on the gas tank cavity partition and a hook d on the brake; a rivet c runs through a fixing hole c on the brake and a fixing hole b on the gas tank cavity partition; and a rivet a runs through a fixing hole a on the gas tank cavity partition and a fixing hole d on the actuating rod, a pressing rod is provided at the one end of the actuating rod, and a rivet b runs through an elongated hole on the gas tank cavity partition, a connecting hole on the pull rod, and a sliding track slot on the actuating rod.

The bounce limiting device comprises a pull rod slidably connected to the gas tank cavity partition, a gas tank driving part at an end of the pull rod penetrates through the gas tank cavity partition and is positioned in a gas tank cavity, the end of the actuating rod is movably connected to the pull rod, a spring a is connected between the pull rod and the gas tank cavity partition, a position-limiting notch is formed at the bottom end of the pull rod, a position-limiting piece b matching the position-limiting notch is provided on a brake, a guide slot b extending vertically is formed on the gas tank cavity partition, a guide piece b movable up and down along the guide slot b is provided on the brake, a position-limiting stopper is provided at the top of the guide piece b, a spring c is connected between the brake and the gas tank cavity partition, a push plane is provided at the top of the brake, and the height of the push plane is not lower than the bearing end.

An accommodating cavity for accommodating the spring c is provided at the bottom of the brake, the top end of the spring c is connected to the upper wall in the accommodating cavity, the bottom of the spring c is connected to a bent piece on the gas tank cavity partition, guide pieces c are fixed on both sides of the bottom of the accommodating cavity, and the guide pieces c movable up and down along a guide slot c on the gas tank cavity partition.

The beneficial effect of the present invention is: by providing the bounce limiting device and using same in conjunction with the liquid holding tray, operating by users is standardized to avoid dangerous accidents caused by incorrect operating.

Figure 1:
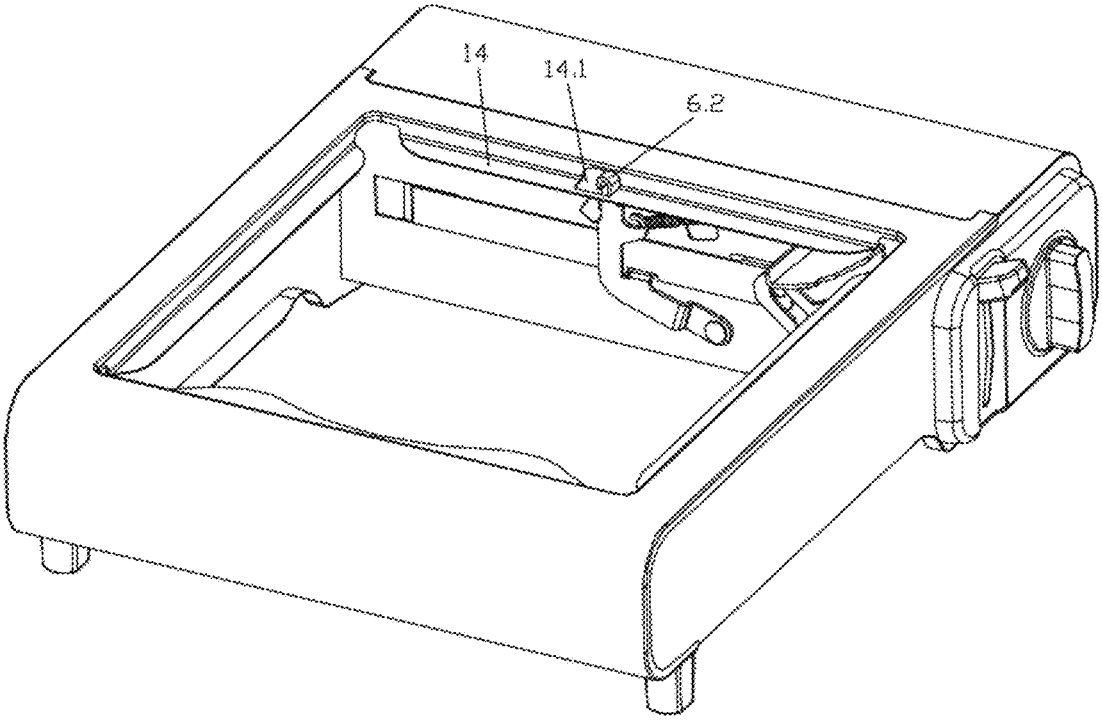
FIG. 1 is structural diagram I of the present invention.
Figure 2:
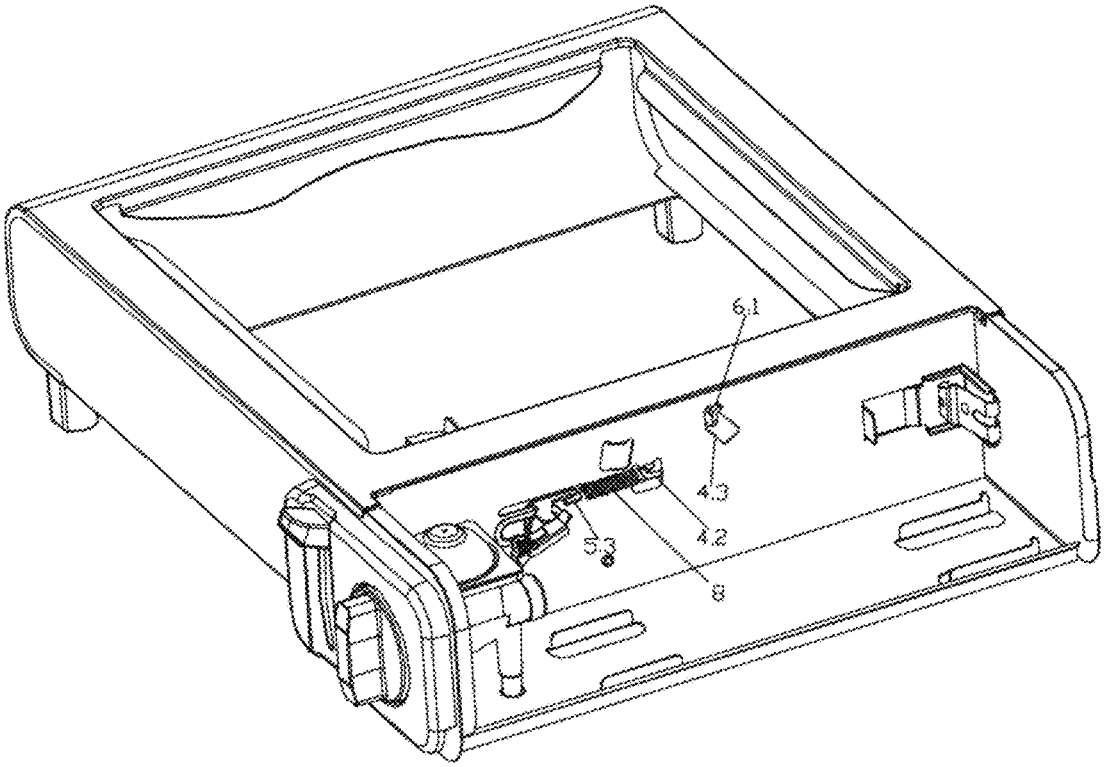
FIG. 2 is structural diagram II of the present invention.
Figure 3:
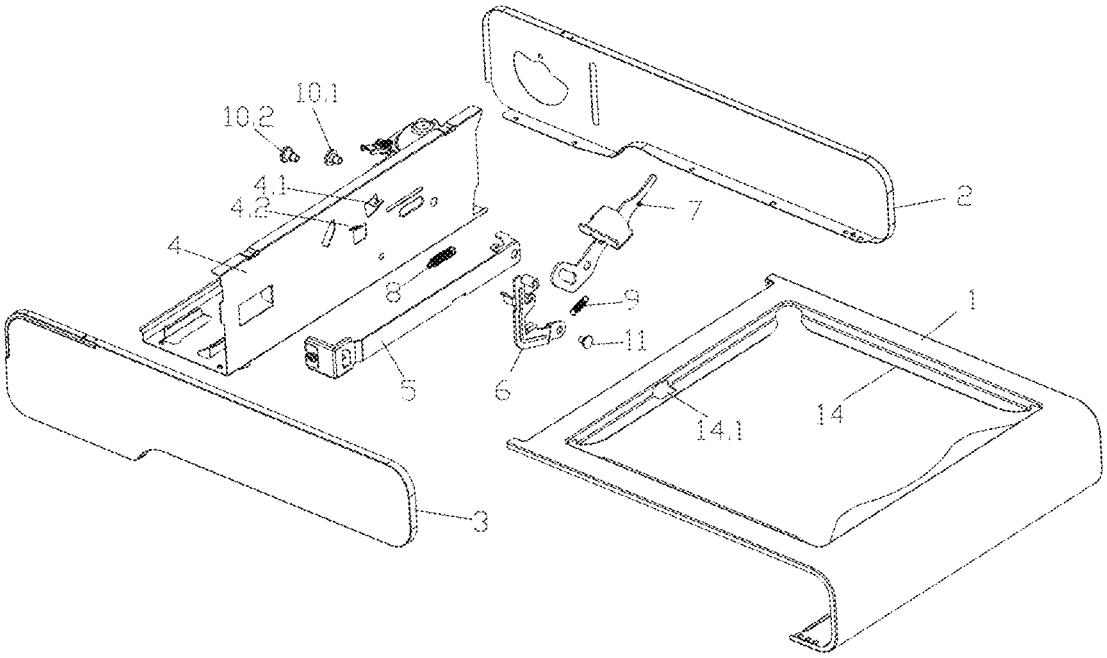
FIG. 3 is the exploded view of the present invention.
Figure 4:
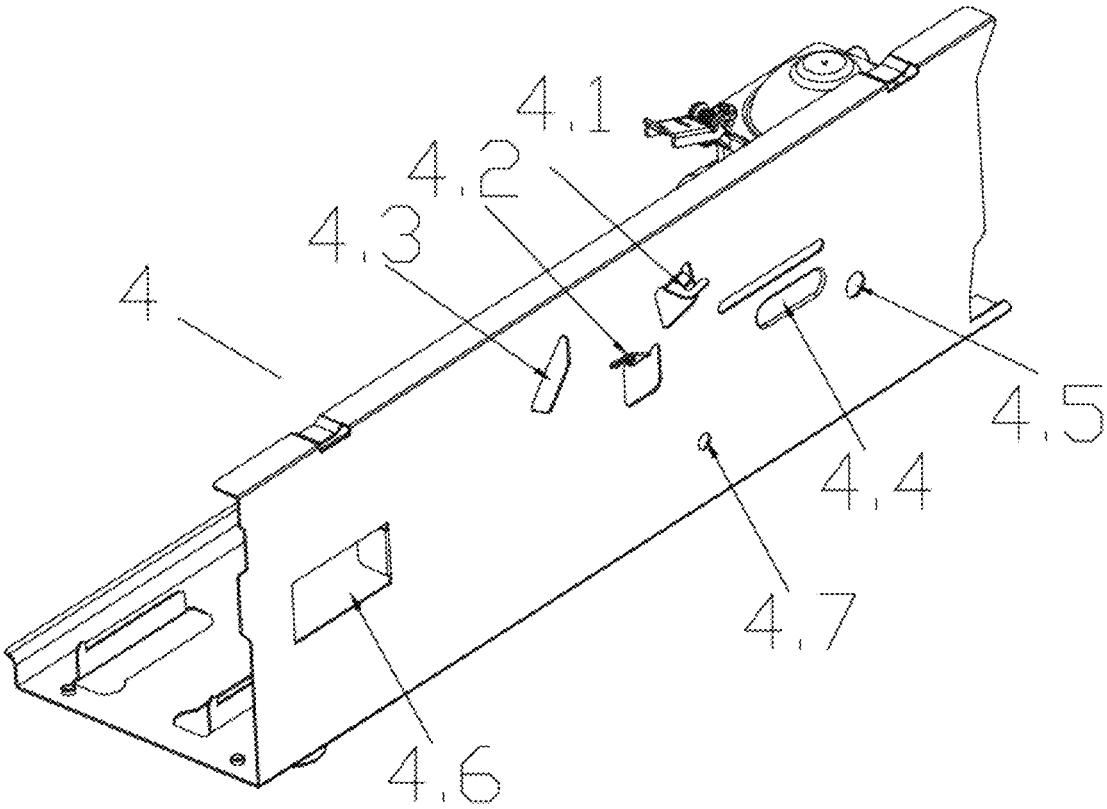
FIG. 4 is the structural diagram of the gas tank cavity partition.
Figure 5:
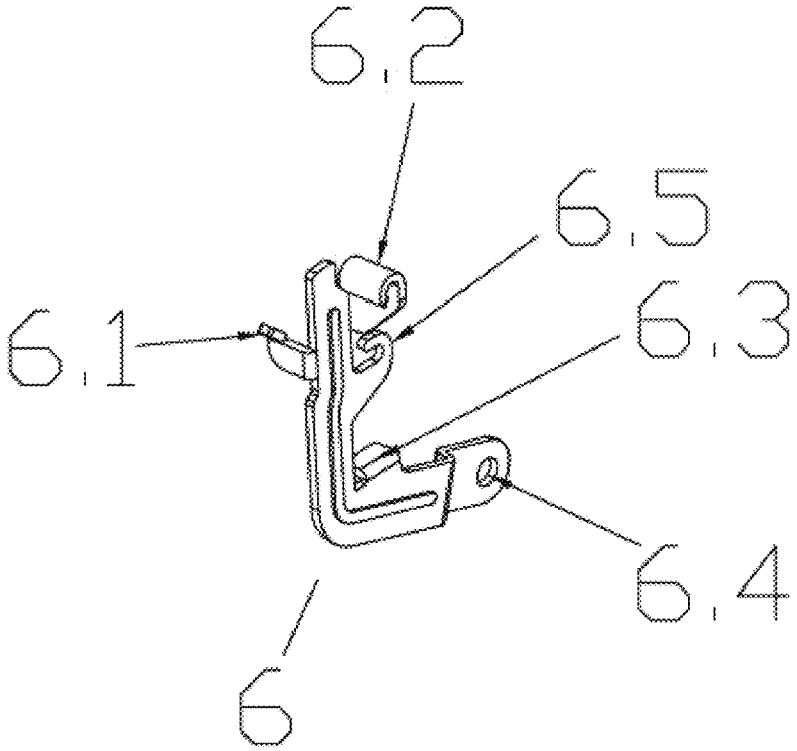
FIG. 5 is the structural diagram of the brake.
Figure 6:
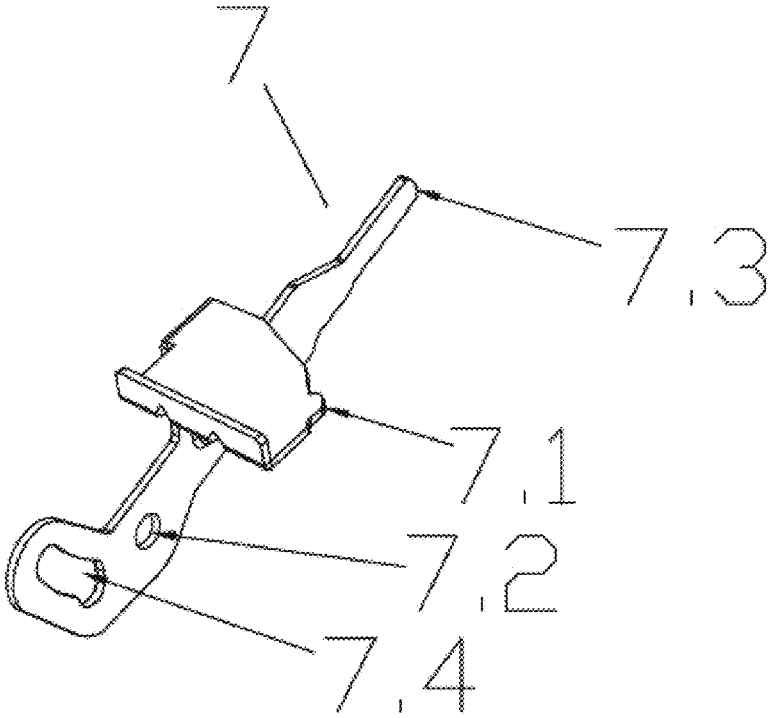
FIG. 6 is the structural diagram of the actuating rod.
Figure 7:
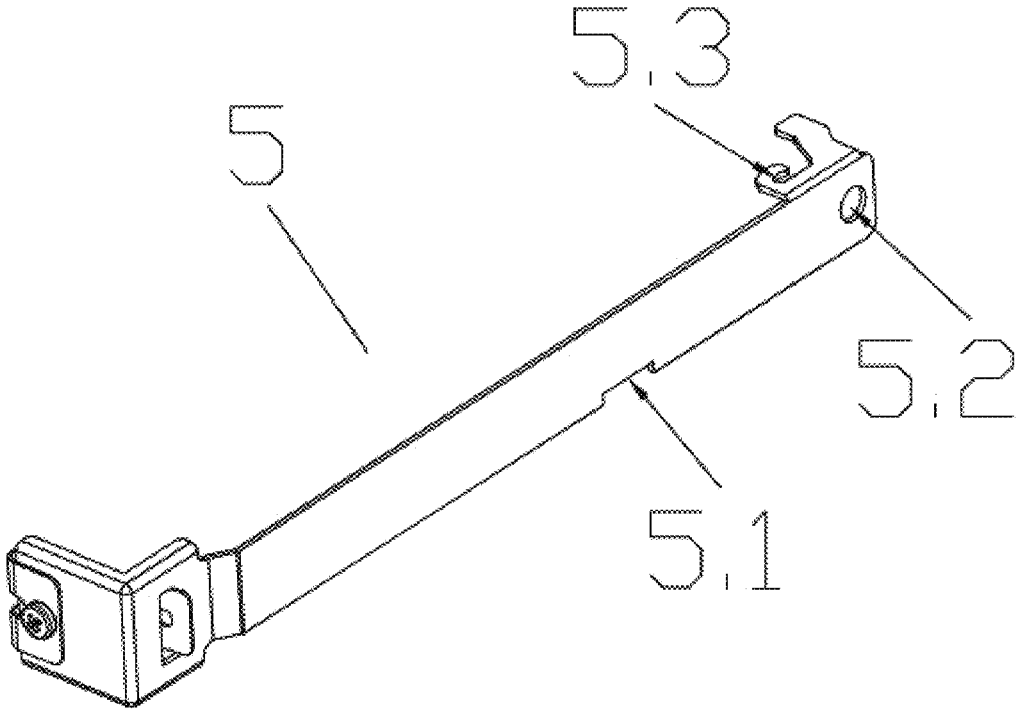
FIG. 7 is the structural diagram of the pull rod.
Figure 8:
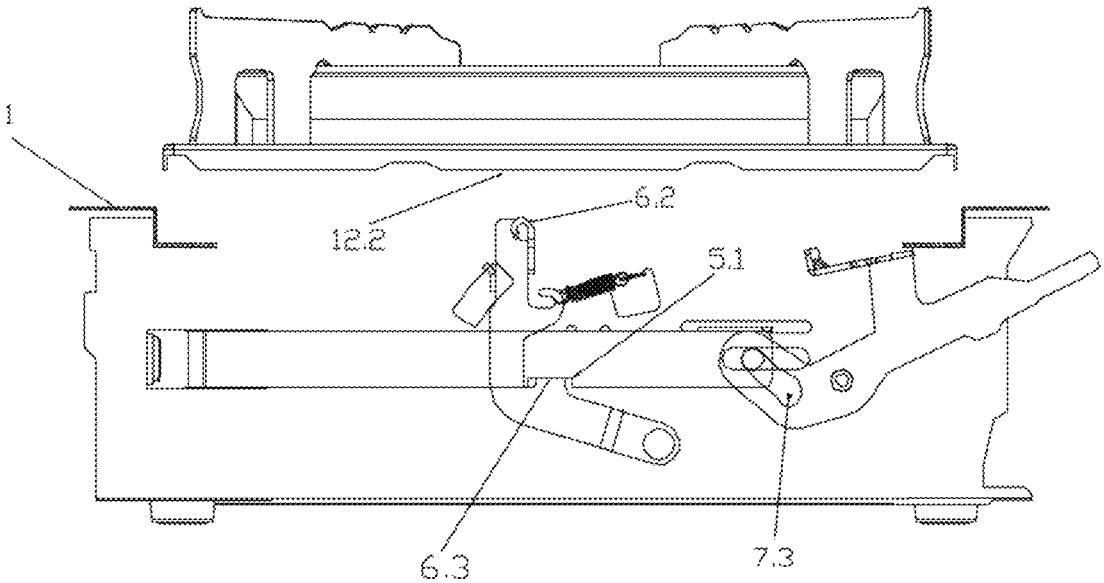
FIG. 8 is sectional view I of the present invention.
Figure 9:
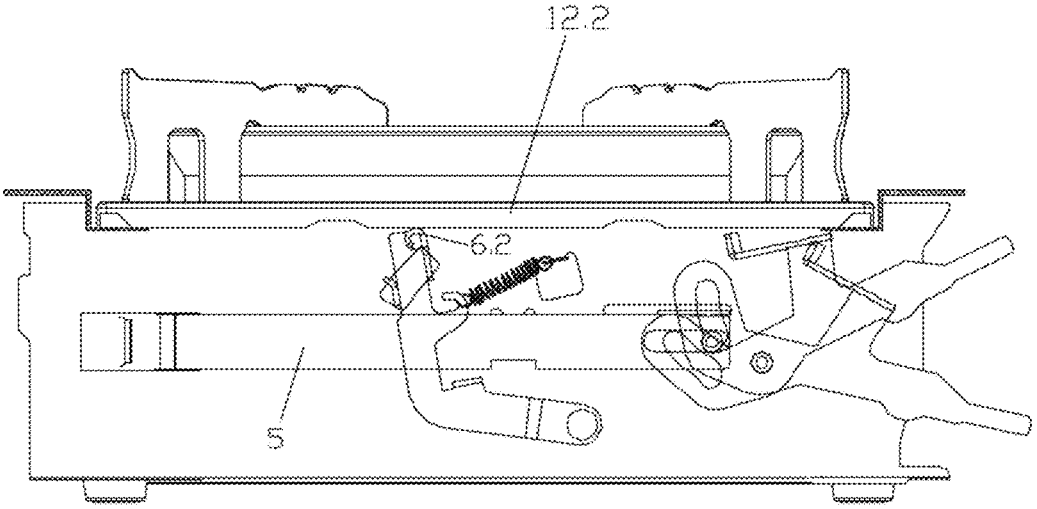
FIG. 9 is the schematic diagram for correct placement of the liquid holding tray.
Figure 10:
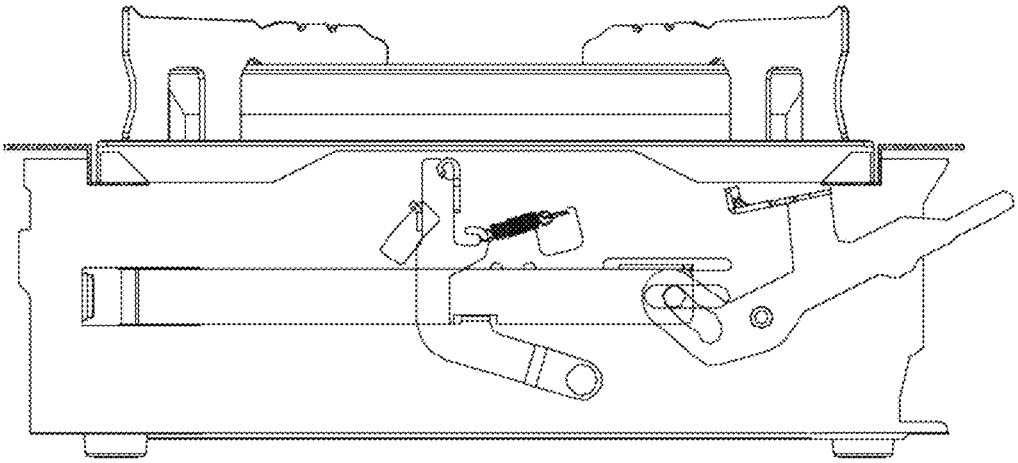
FIG. 10 is the schematic diagram for incorrect placement of the liquid holding tray.
Figure 11:
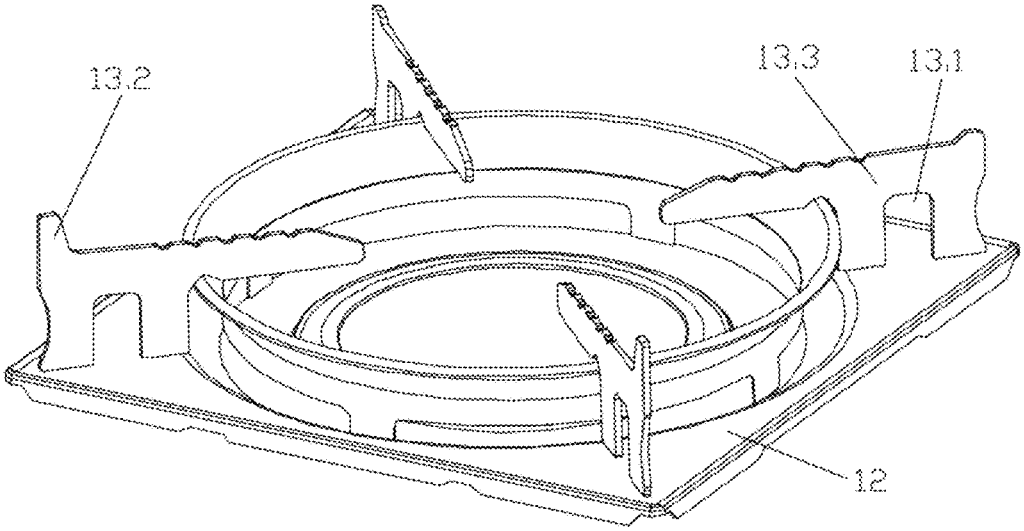
FIG. 11 is structural diagram I of the liquid holding tray.
Figure 12:
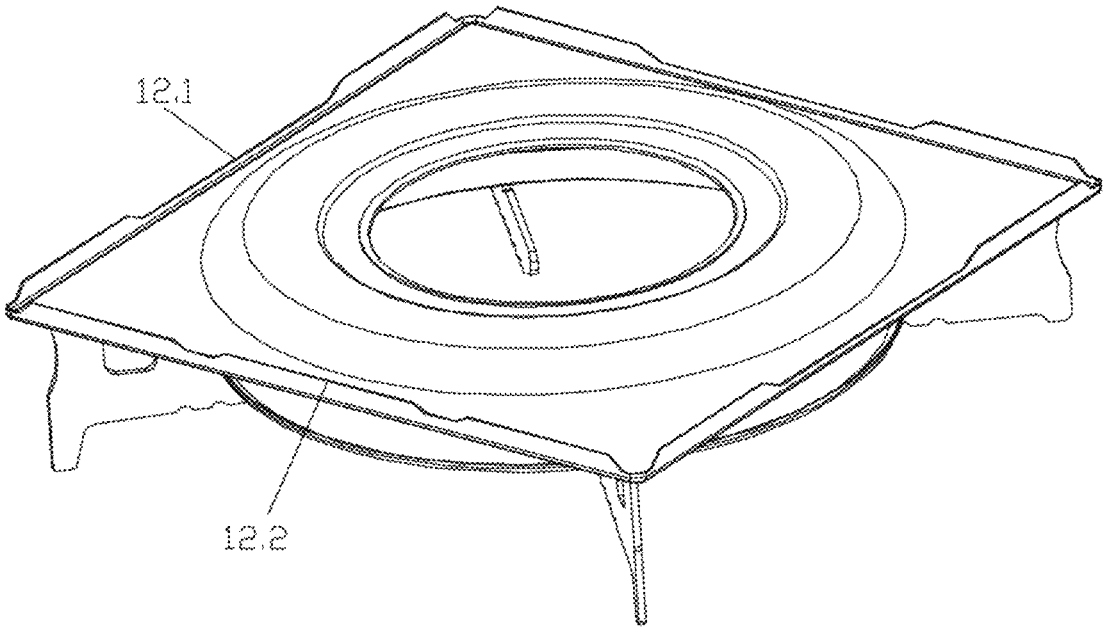
FIG. 12 is structural diagram II of the liquid holding tray.

Reference numerals in the drawings are as follows: 1. upper panel, 2. front panel, 3. back panel, 4. gas tank cavity partition, 4.1. hook a, 4.2. hook b, 4.3. guide slot a, 4.4. elongated hole, 4.5. fixing hole a, 4.6. square guide hole, 4.7. fixing hole b, 4.8. guide slot b, 4.9. guide slot c, 4.10. bent piece, 5. pull rod, 5.1. position-limiting notch, 5.2. connecting hole, 5.3. hook c, 6. brake, 6.1. guide piece a, 6.2. arc-shaped surface, 6.3. position-limiting piece a, 6.4. fixing hole c, 6.5. hook d, 6.6. position-limiting piece b, 6.7. push plane, 6.8. guide piece b, 6.9. position-limiting stopper, 6.10. guide piece c, 7. actuating rod, 7.1. position-limiting baffle, 7.2. fixing hole d, 7.3. pressing rod, 7.4. sliding track slot, 8. spring a, 9. spring b, 10.1, rivet a, 10.2. rivet b, 11. rivet c, 12. liquid holding tray, 12.1. avoidance groove, 12.2. pressing piece, 13.1. hob foot groove, 13.2. high hob foot, 13.3. low hob foot, 14. bearing end, 14.1. avoidance hole, 15. spring c, and 16. cooking pan.

DETAILED DESCRIPTION

The present invention is further descried below in combination with FIG. 1 to FIG. 19.

An error-proof operating system for a portable gas hob, comprising a gas tank cavity partition 4 having two ends respectively fixed to a front panel 2 and a back panel 3, where a bounce limiting device is provided on the gas tank cavity partition 4, the bounce limiting device is connected to an actuating rod 7, the actuating rod 7 is rotatably connected to the gas tank cavity partition 4, one end of the actuating rod 7 penetrates through the front panel 2, and the top of the bounce limiting device is not lower than a bearing end 14 for bearing a liquid holding tray 12.

Figure 13:
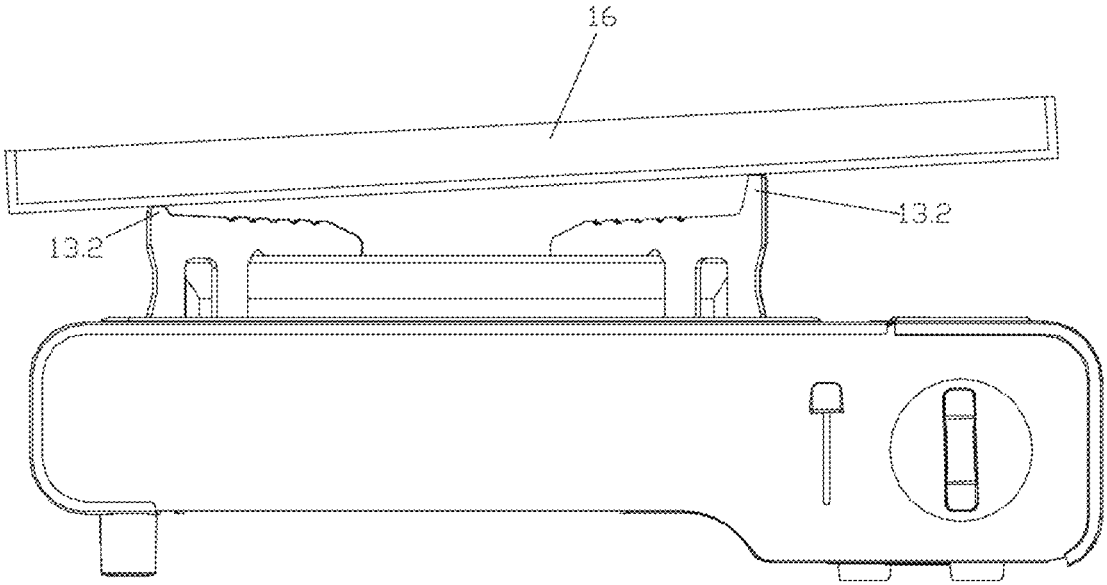
FIG. 13 is the schematic diagram of placing the cooking pan on the liquid holding tray.
Figure 14:
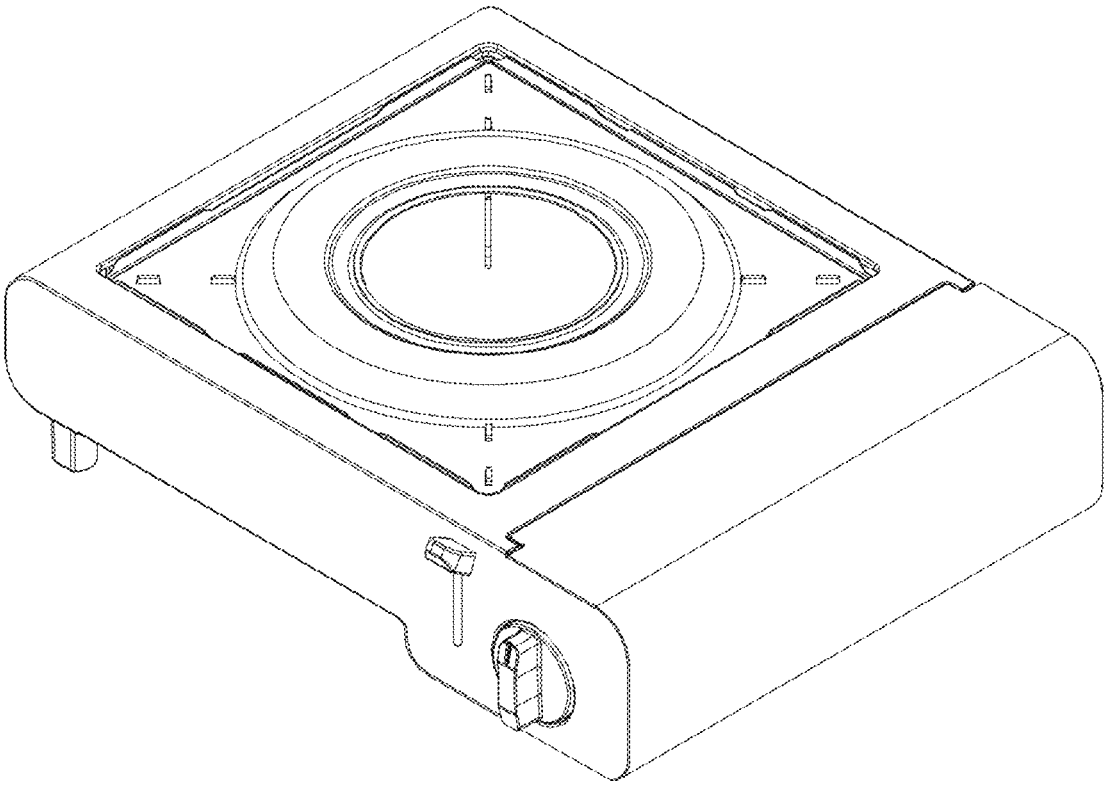
FIG. 14 is the schematic diagram of the storage placement of the liquid holding tray.
Figure 15:
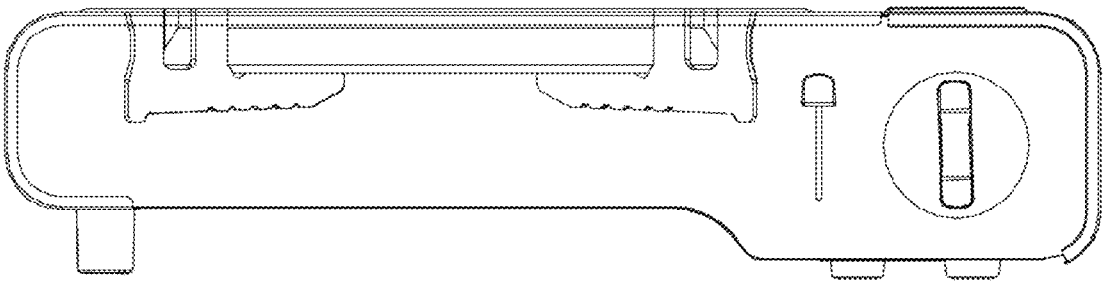
FIG. 15 is the cross-sectional view for FIG. 14.
Figure 16:
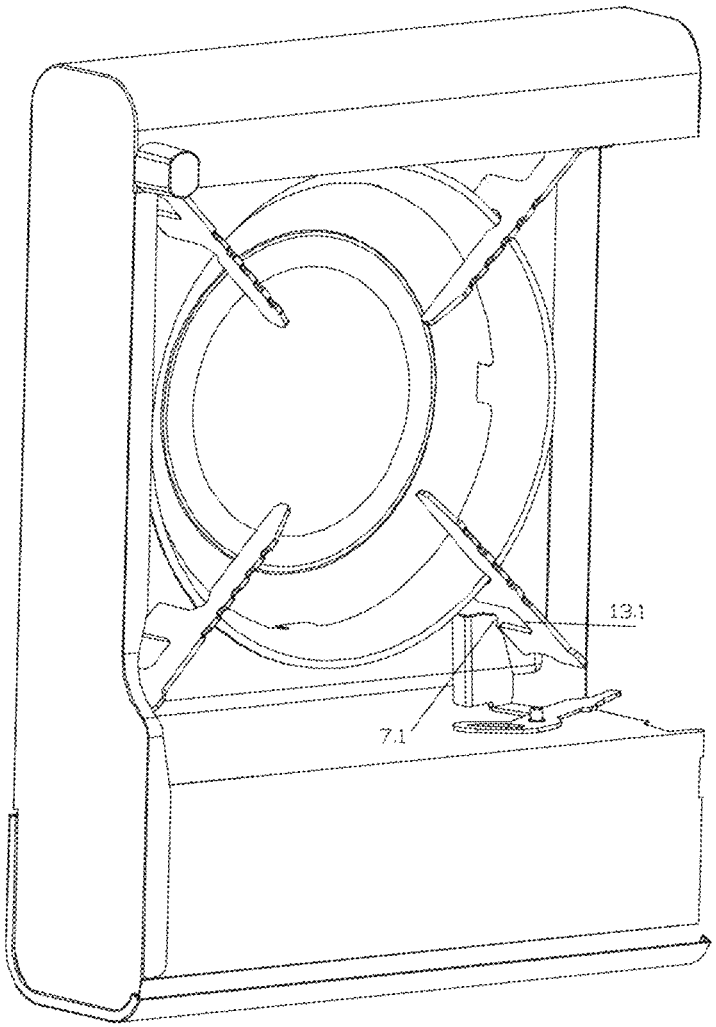
FIG. 16 is the schematic diagram of the position-limiting baffle controlling the hob foot.
Figure 17:
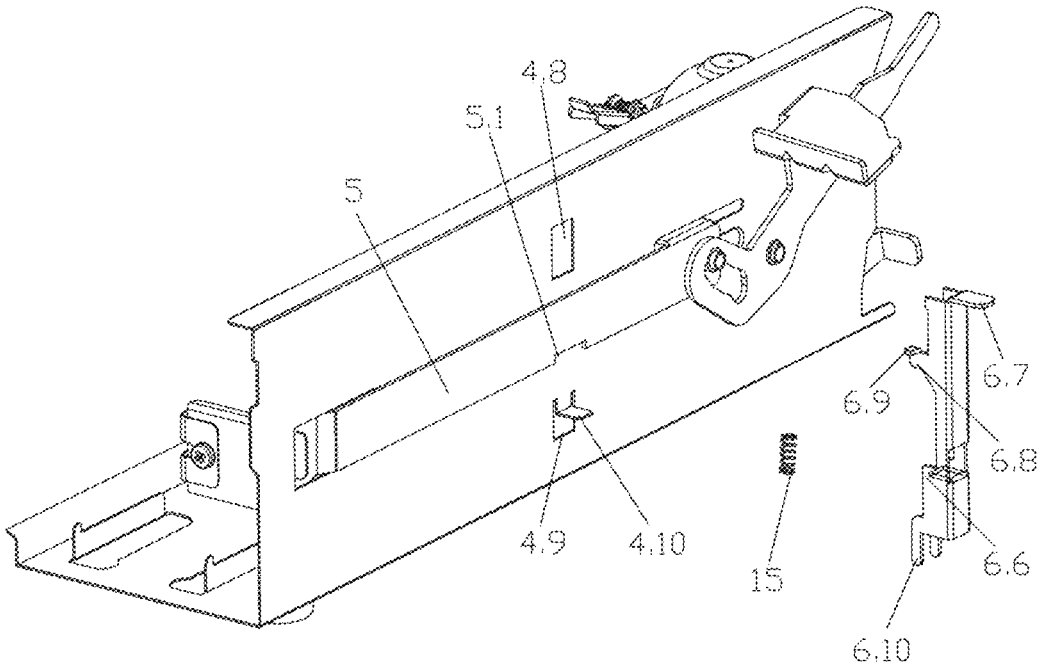
FIG. 17 is the partial exploded view of the brake and the partition.
Figure 18:
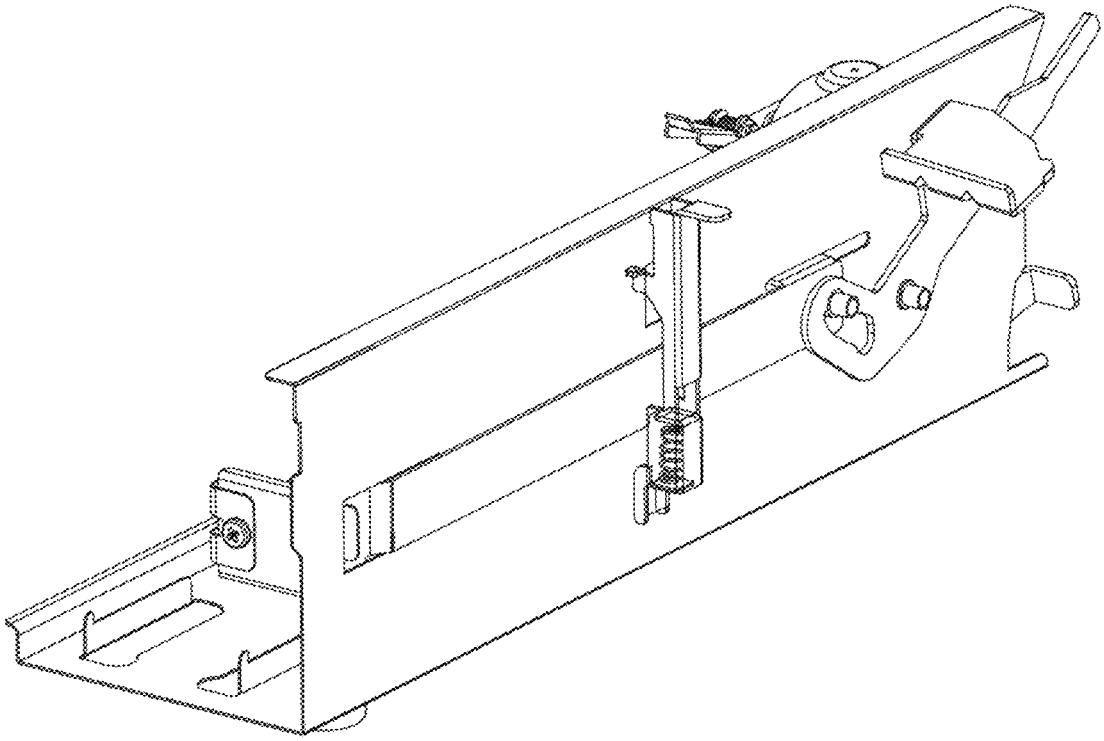
FIG. 18 is the state view of the brake locking the pull rod.
Figure 19:
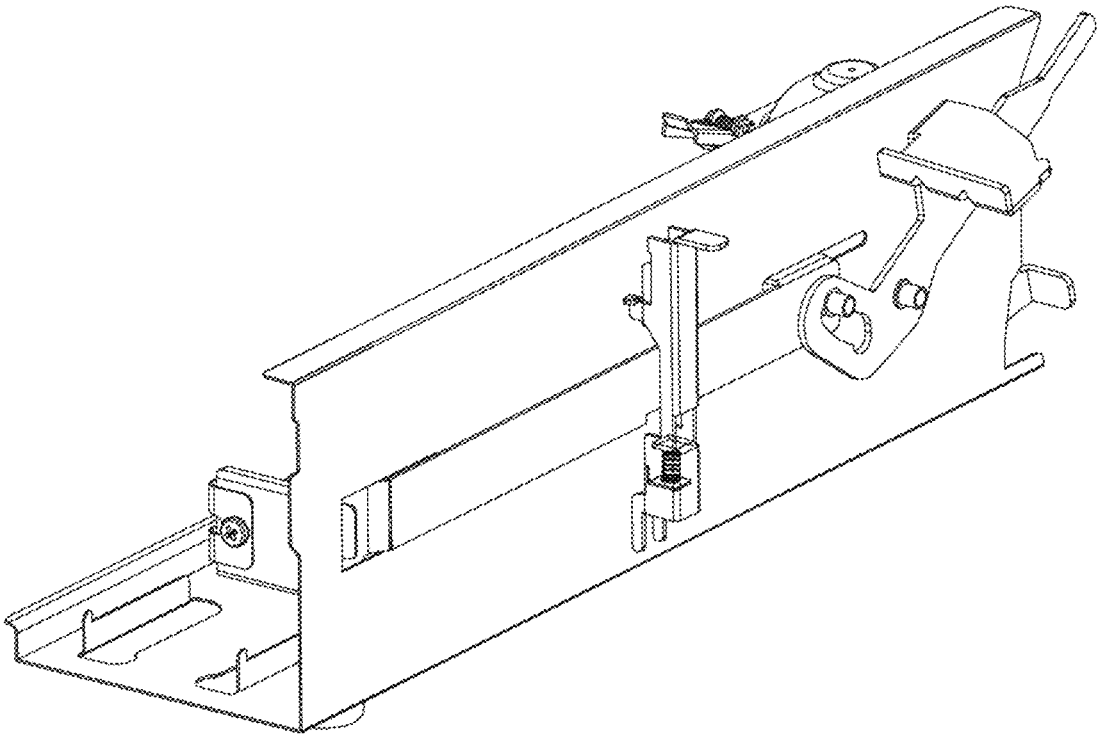
FIG. 19 is the state view the unlocked state of the pull rod.

The bounce limiting device comprises a pull rod 5 slidably connected to the gas tank cavity partition 4, a gas tank driving part at the end of the pull rod 5 penetrates through the gas tank cavity partition 4 and is positioned in a gas cartridge chamber, the end of the actuating rod 7 is movably connected to the pull rod 5, a spring a 8 is connected between the pull rod 5 and the gas tank cavity partition 4, a position-limiting notch 5.1 is formed at the bottom end of the pull rod 5, a position-limiting piece a 6.3 matching the position-limiting notch 5.1 is provided on a brake 6, the brake 6 is movably connected to the gas tank cavity partition 4, a spring b 9 is connected between the brake 6 and the gas tank cavity partition 4, the top of the brake 6 is not lower than the bearing end 14, the brake 6 is rotatably connected to the gas tank cavity partition 4, a guide piece a 6.1 movable along a guide slot a 4.3 is provided on the brake 6, the guide slot a 4.3 is located on the gas tank cavity partition 4, and an arc-shaped surface 6.2 for reducing friction is provided at the top of the brake 6. The liquid holding tray 12 is a square, a pressing piece 12.2 is provided at the bottom of one edge of the square, an avoidance groove 12.1 is formed at the bottom of the other three edges of the square, and the pressing piece 12.2 is in detachable contact with the arc-shaped surface 6.2. Hob feet are fixed at four corners of the liquid holding tray 12, the hob feet comprise two low hob feet 13.3 and two high hob feet 13.2, and the two high hob feet 13.2 are located on two sides of the pressing piece 12.2. When the liquid holding tray 12 is placed correctly, the pressing piece 12.2 presses against the arc-shaped surface 6.2, and the arc-shaped surface 6.2 rotates and moves downwards to drive the entire brake 6 to rotate and move down, the design of the arc-shaped surface 6.2 can effectively reduce the resistance caused by the relative sliding with the pressing piece 12.2; and the position-limiting piece a 6.3 of the brake 6 is separated from the position-limiting notch 5.1 on the pull rod 5, and the pull rod 5 is released from a locked state. In this case, the pressing rod 7.3 at the end of the actuating rod 7 is pressed down, the actuating rod 7 rotates around a rivet a 10.1, the pull rod 5 is pulled through the rivet b 10.2 to move in the direction of the front panel 2, extending to the other end of the pull rod 5 in the gas tank cavity pushes the gas outlet of the gas tank in the gas tank cavity to move towards the gas inlet of the valve body, and after the gas channel is connected, the gas is supplied to the valve body and the hub burner. Two low hob feet 13.3 and two high hob feet 13.2 are provided, so that cookware such as the cooking pan 16 can be placed obliquely (as shown in FIG. 13), thereby increasing the distance from one side of the cooking pan 16 to the gas tank cavity, reducing the transfer of heat from the cooking pan to the gas tank cavity, and making the hob safer to use. The high hob feet 13.2 are located on two sides of the pressing piece 12.2, such that only when the two high hob feet 13.2 on the liquid holding tray 12 are both located on the proximal side of the gas tank cavity partition 4, can the arc-shaped surface 6.2 at the top of the brake 6 be pressed down through the pressing piece 12.2 at the bottom and the pull rod 5 be released from the locked state; and the avoidance groove 12.1 is formed on the other three sides of the liquid holding tray 12, such that the arc-shaped surface 6.2 cannot be pressed down at the three sides. As a result, only when the liquid holding tray 12 is placed correctly, can the gas hob be unlocked and used. After the liquid holding tray 12 is removed, the pressing piece 12.2 is separated from the arc-shaped surface 6.2, and under the action of the spring a 8 and the spring b 9, the pull rod 5 and the brake 6 are reset.

A position-limiting baffle 7.1 is provided on the actuating rod 7, and a hob foot groove 13.1 matching the position-limiting baffle 7.1 is formed at the bottom of each hob foot.

An upper panel 1 is fixed between the front panel 2 and the back panel 3, the bearing end 14 is fixed onto an inner ring of the upper panel 1, an avoidance hole 14.1 is opened on the bearing end 14, and the top of the brake 6 runs through the avoidance hole 14.1.

A square guide hole 4.6 is opened on the gas tank cavity partition 4, and one end of the pull rod 5 moves along the square guide hole 4.6.

One end of the spring a 8 is connected to a hook c 5.3 on the pull rod 5, and the other end of the spring a 8 is connected to a hook b 4.2 on the gas tank cavity partition 4; two ends of the spring b 9 are respectively connected to a hook a 4.1 on the gas tank cavity partition 4 and a hook d 6.5 on the brake 6; a rivet c 11 runs through a fixing hole c 6.4 on the brake 6 and a fixing hole b 4.7 on the gas tank cavity partition 4; and a rivet a 10.1 runs through a fixing hole a 4.5 on the gas tank cavity partition 4 and a fixing hole d 7.2 on the actuating rod 7, a pressing rod 7.3 is provided at the one end of the actuating rod 7, and a rivet b 10.2 runs through an elongated hole 4.4 on the gas tank cavity partition 4, a connecting hole 5.2 on the pull rod 5, and a sliding track slot 7.4 on the actuating rod 7.

As another embodiment of the present application, the brake 6 is designed in a manner of sliding up and down. Specifically, the bounce limiting device comprises a pull rod 5 slidably connected to the gas tank cavity partition 4, a gas tank driving part at the end of the pull rod 5 penetrates through the gas tank cavity partition 4 and is positioned in a gas tank cavity, the other end of the actuating rod 7 is movably connected to the pull rod 5, a spring a 8 is connected between the pull rod 5 and the gas tank cavity partition 4, a position-limiting notch 5.1 is formed at the bottom end of the pull rod 5, a position-limiting piece b 6.6 matching the position-limiting notch 5.1 is provided on a brake 6, a guide slot b 4.8 extending vertically is formed on the gas tank cavity partition 4, a guide piece b 6.8 movable up and down along the guide slot b 4.8 is provided on the brake 6, a position-limiting stopper 6.9 is provided at the top of the guide piece b 6.8, a spring c 15 is connected between the brake 6 and the gas tank cavity partition 4, a push plane 6.7 is provided at the top of the brake 6, and the push plane 6.7 is located above the bearing end 14. An accommodating cavity for accommodating the spring c 15 is formed at the bottom of the brake 6, the top end of the spring c 15 is connected to the upper wall in the accommodating cavity, the bottom of the spring c 15 is connected to a bent piece 4.10 on the gas tank cavity partition 4, guide pieces c 6.10 are fixed on two sides of the bottom of the accommodating cavity, and the guide pieces c 6.10 movable up and down along a guide slot c 4.9 on the gas tank cavity partition 4. When the liquid holding tray 12 is not placed on the bearing end 14, under the action of the spring c 15, the push plane 6.7 is located above the bearing end 14, and the top of the position-limiting piece b 6.6 is clamped into the position-limiting notch 5.1 so as to lock the position of the pull rod 5 and thus lock the actuating rod 7; and after liquid holding tray 12 is placed on the bearing end 14, the push plane 6.7 is pressed down, the position-limiting piece b 6.6 moves downwards to be separated from the position-limiting notch 5.1, and the pull rod 5 can move transversely, in which case a pressing rod 7.3 is pressed down to drive the pull rod 5 to move, thereby achieving smooth and normal use of a gas hob.

The above are only preferred embodiments of the present invention. It should be noted that many modifications and variations can be made thereto for a person skilled in the art without departing from the technical principle of the present invention, and those modifications and variations should also be regarded as falling within the scope of protection of the present invention.

What is claimed is:

1. An error-proof operating system for a portable gas hob, comprising:
- a gas tank cavity partition having two ends respectively fixed to a front panel and a back panel, wherein;
- a bounce limiting device is provided on the gas tank cavity partition,
- the bounce limiting device is connected to an actuating rod,
- the actuating rod is rotatably connected to the gas tank cavity partition, one end of the actuating rod penetrates through the front panel,
- a top of the bounce limiting device is not lower than a bearing end for bearing a liquid holding tray,
- the bounce limiting device comprises a pull rod slidably connected to the gas tank cavity partition,
- a gas tank driving part at an end of the pull rod penetrates through the gas tank cavity partition and is positioned in a gas tank cavity,
- the end of the actuating rod is movably connected to the pull rod,
- a first spring is connected between the pull rod and the gas tank cavity partition,
- a position-limiting notch is formed at a bottom end of the pull rod,
- a first position-limiting piece matching the position-limiting notch is provided on a brake,
- the brake is movably connected to the gas tank cavity partition,
- a second spring is connected between the brake and the gas tank cavity partition,
- a top of the brake is not lower than the bearing end,
- the brake is rotatably connected to the gas tank cavity partition,
- a first guide piece movable along a first guide slot is provided on the brake,
- the first guide slot is located on the gas tank cavity partition, and
- an arc-shaped surface for reducing friction is provided at the top of the brake.

2. The error-proof operating system for the portable gas hob according to claim 1, wherein:
- the liquid holding tray is a square,
- a pressing piece is provided at a bottom of one edge of the square,
- an avoidance groove is formed at the bottom of the other three edges of the square, and
- the pressing piece is in detachable contact with the arc-shaped surface.

3. The error-proof operating system for the portable gas hob according to claim 2, wherein:
- hob feet are fixed at four corners of the liquid holding tray,
- the hob feet comprise two low hob feet and two high hob feet, and
- the two high hob feet are located on both sides of the pressing piece.

4. The error-proof operating system for the portable gas hob according to claim 3, wherein:
- a position-limiting baffle is provided on the actuating rod, and
- a hob foot groove matching the position-limiting baffle is formed at a bottom of each hob foot.

5. The error-proof operating system for the portable gas hob according to claim 1, wherein:
- an upper panel is fixed between the front panel and the back panel,
- the bearing end is fixed onto an inner ring of the upper panel,
- an avoidance hole is opened on the bearing end, and
- the top of the brake runs through the avoidance hole.

6. The error-proof operating system for the portable gas hob according to claim 1, wherein:
- a square guide hole is opened on the gas tank cavity partition, and
- one end of the pull rod moves along the square guide hole.

7. The error-proof operating system for the portable gas hob according to claim 1, wherein:

one end of the first spring is connected to a first hook on the pull rod, and the other end of the first spring is connected to a second hook on the gas tank cavity partition, two ends of the second spring are respectively connected to a third hook on the gas tank cavity partition and a fourth hook on the brake, a first rivet runs through a first fixing hole on the brake and a second fixing hole on the gas tank cavity partition, a second rivet runs through a third fixing hole on the gas tank cavity partition and a fourth fixing hole on the actuating rod, a pressing rod is provided at the one end of the actuating rod, and a third rivet runs through an elongated hole on the gas tank cavity partition, a connecting hole on the pull rod, and a sliding track slot on the actuating rod.

8. The error-proof operating system for the portable gas hob according to claim 1, wherein:

a second position-limiting piece matching the position-limiting notch is provided on a brake, a second guide slot extending vertically is formed on the gas tank cavity partition, a second guide piece movable up and down along the second guide slot is provided on the brake, a position-limiting stopper is provided at a top of the second guide piece, a third spring is connected between the brake and the gas tank cavity partition, a push plane is provided at the top of the brake, and a height of the push plane is not lower than the bearing end.

9. The error-proof operating system for the portable gas hob according to claim 8, wherein:

an accommodating cavity for accommodating the third spring is provided at a bottom of the brake, a top end of the third spring is connected to an upper wall in the accommodating cavity, a bottom of the third spring is connected to a bent piece on the gas tank cavity partition, third guide pieces are fixed on both sides of the bottom of the accommodating cavity, and the third guide pieces are movable up and down along a third guide slot on the gas tank cavity partition.

* * * * *